US005979566A

United States Patent [19]

Frankman

[11] Patent Number: 5,979,566

[45] Date of Patent: Nov. 9, 1999

[54] FIRE EXTINGUISHING APPARATUS

[76] Inventor: C. William Frankman, 758 Washington Ave., Greenville, Ohio 45331

[21] Appl. No.: 08/789,945

[22] Filed: Jan. 27, 1997

[51] Int. Cl.[6] ..... A62C 27/00

[52] U.S. Cl. ..... 169/52

[58] Field of Search ..... 169/43, 46, 47, 169/52, 54, 91; 15/313, 352; 406/48

[56] References Cited

U.S. PATENT DOCUMENTS

| | | | |
|---|---|---|---|
| 1,351,700 | 8/1920 | Smith | 169/52 X |
| 4,453,286 | 6/1984 | Wieland | 15/313 |
| 4,567,623 | 2/1986 | Walton | 15/352 X |
| 5,001,807 | 3/1991 | Arai | 15/352 X |
| 5,740,867 | 4/1998 | Jansson | 169/54 X |

*Primary Examiner*—Andrew C. Pike
*Attorney, Agent, or Firm*—R. William Graham

[57] ABSTRACT

A fire extinguishing apparatus for use in collecting and extinguishing relatively lightweight Class A material includes a vacuum with an associated hopper, a conduit extending from the vacuum, and extinguisher connected to the conduit. Also, provided is a method of collecting and extinguishing relatively lightweight Class A material, which includes the steps of (a) causing the Class A material to be forcibly moved through a contained passageway and (b) extinguishing the Class A material as it passes through the contained passageway.

6 Claims, 3 Drawing Sheets

FIRE EXTINGUISHING APPARATUS

BACKGROUND OF THE INVENTION

1. Field of the Invention

The present invention relates to the field of a fire extinguishing apparatus and a method of use therefor. More particularly, but not by way of limitation, the invention relates to a fire extinguishing apparatus and a method of use for collecting and extinguishing loose and relatively lightweight Class A material.

2. Prior Art

Presently, there exist many types of apparatus and methods for extinguishing building fires. Most commonly, building fires are dowsed with water using conventional fire truck and associated equipment.

Once the building fire has been sufficiently contained, there remains a great deal of potentially lightweight Class A material, such as blown insulation, paper, or grain with storage bins for example, wherein burning embers may exist. The removal of such material is presently a cumbersome and lengthy process. It requires use of buckets wherein firemen set up a removal line such that the insulation passes out of the building by hand. Once removed from the building, each bucket of material is further extinguished.

There remains a need to provide an apparatus and method which obviate the present apparatus and methods for removal of Class A lightweight material, such as insulation. The fire extinguishing apparatus and method of the present invention solve these problems.

BRIEF SUMMARY OF THE INVENTION

It is an object to improve fire extinguishing apparatus.

It is also an object to improve fire extinguishing apparatus for collection and disposal of lightweight Class A material.

It is another object to ease the removal of lightweight Class A material from a building.

It is yet another object to reduce the manpower needed in removal of lightweight Class A material.

Accordingly, the present invention is directed to a fire extinguishing apparatus for use in collecting and extinguishing relatively lightweight Class A material and includes a vacuum with an associated hopper, a conduit extending from the vacuum, and extinguisher connected thereto. The vacuum and hopper are of a mobile type which are conventionally used for leaf collection or the like in local municipalities. The conduit is preferably flexible and has an end adapted to fit to an inlet of the vacuum and has the extinguisher connected thereto such that the Class A material is extinguished as it passes through the conduit. Otherwise stated, the invention is a fire extinguishing apparatus for use in collecting and extinguishing relatively lightweight Class A material, which includes means for creating a vacuum, a conduit operably connected to the vacuum means for aid in collecting the Class A material, and means operably associated with the conduit for extinguishing the Class A material as the Class A material passes through the conduit.

A method of the invention is also provided. It includes the steps of (a) causing the Class A material to be forcibly moved through a contained passageway and (b) extinguishing the Class A material as it passes through the contained passageway.

Other objects and advantages will be readily apparent to those skilled in the art upon viewing the drawings and reading the detailed description hereafter.

DETAILED DESCRIPTION OF THE INVENTION

Figure 1:
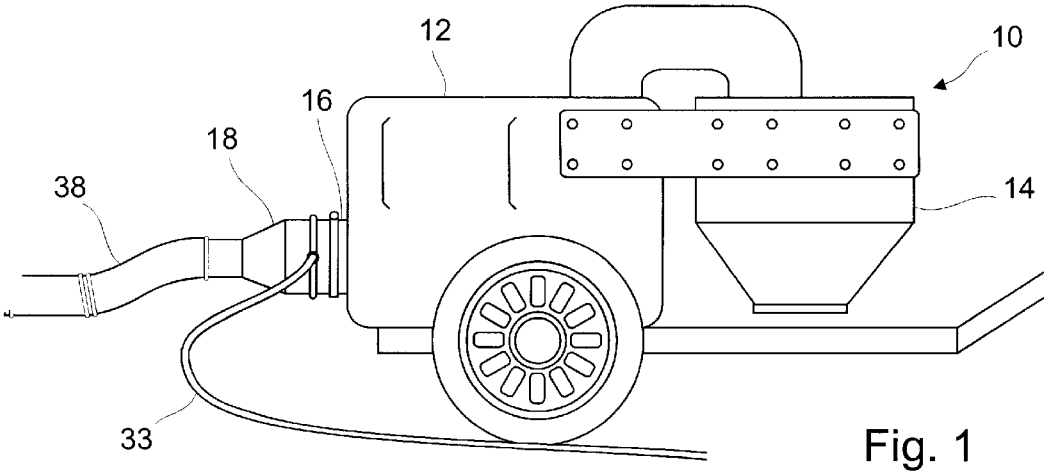
FIG. 1 is a side view of a fire extinguishing apparatus of the present invention.
Figure 2:
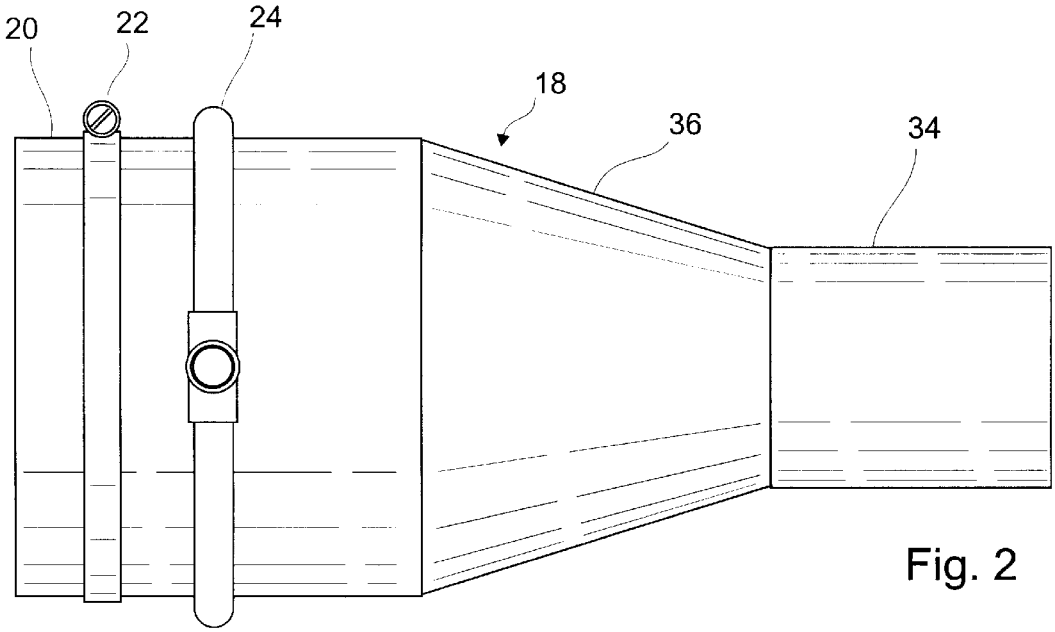
FIG. 2 is a side view of a fire extinguishing adapter of the present invention.
Figure 3:
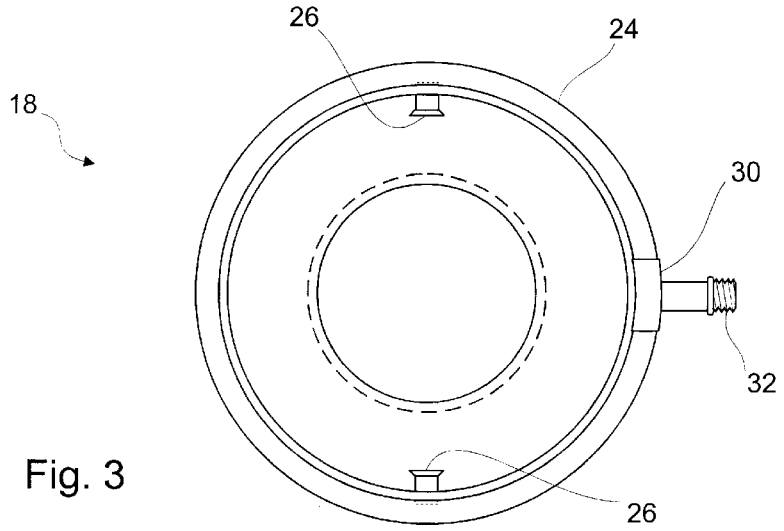
FIG. 3 is an end view of the adapter of FIG. 2 taken from the left.

Referring now to the drawings, the fire extinguishing apparatus is generally designated by the number 10. The fire extinguishing apparatus 10 is mobile and includes a power driven vacuum/shredding system 12 having an associated hopper 14 of the type which is commonly employed for use in collection of leaves (lightweight subject matter collected) by public street service companies.

The fire extinguishing apparatus 10 also includes an inlet 16 of a predetermined diameter through which the subject matter is to be collected and passed to the hopper 14. Connected to the inlet 16 is a fire extinguishing adapter 18 which has an end 20 of a slightly larger inner diameter than an outer diameter of the inlet 16. The end 20 can be slid over the inlet 16 and held in place by a threaded screw-type band clamp 22. However, it is contemplated that the other connecting means readily exist and will be apparent to those skilled in the art and should be included as within the teachings of the present invention. In this regard, the diameter of the end 20 may smaller or of generally the same size as the inlet 16 to enable the particular connection desired.

Disposed on the end 20 is a conduit 24 having spray nozzles 26 which extend through open surfaces 28 of the end 20. Communicatively connected to the conduit 24 is an adapter 30 which is shown here as a T-line conduit adapter having a threaded end 32. This threaded end 32 may be connected to a water hose, such as a garden-type hose 33 for purposes of supplying water or other suitable fire extinguishant.

The fire extinguishing adapter 18 has another end 34 of a smaller diameter than the end 20. A tapered intermediate section 36 interconnects the ends 34 and 20. This design permits the expansive dispersion of particulate or subject matter 40 as it passes from the end 34 to the end 20.

A flexible hose 38 is connected to the end 34 and is preferably of a size and length suitable to permit reaching remote places where the subject matter to be removed exists. Particularly, the present invention contemplates using the invention to remove insulation within a building, wherein the insulation has burning embers existing therein and is presently removed by hand bucket and dowsed with water/extinguishant upon removal. Such existing techniques are slow and cumbersome.

Figure 4:
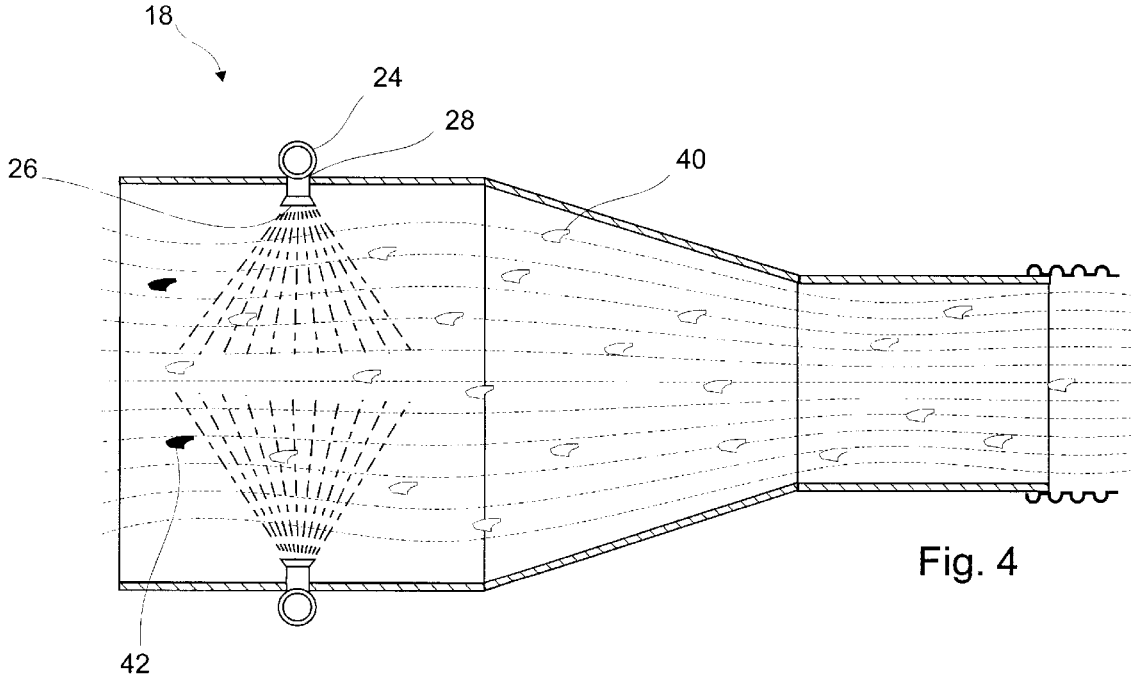
FIG. 4 is a cross-sectional view of part of the adapter of FIG. 2 representing Class A material being extinguished as it passes therethrough.

In the present invention, the insulation particulate 40 is vacuumed out of the site in a relatively quick manner and sprayed radially inward through nozzles 26 with water or suitable extinguishant such that the extinguishant crosses as it passes through the fire extinguishing adapter 18 as depicted in FIG. 4 resulting in extinguished particulate 42.

Figure 5:
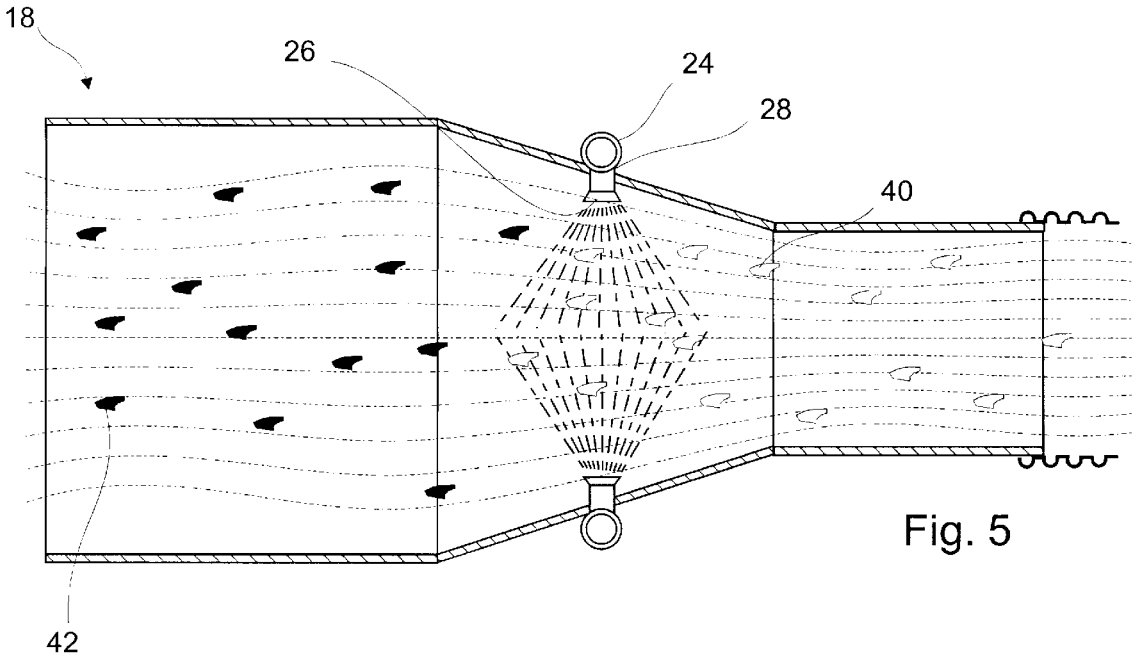
FIG. 5 is a cross-sectional view of another embodiment of the present invention.
Figure 6:
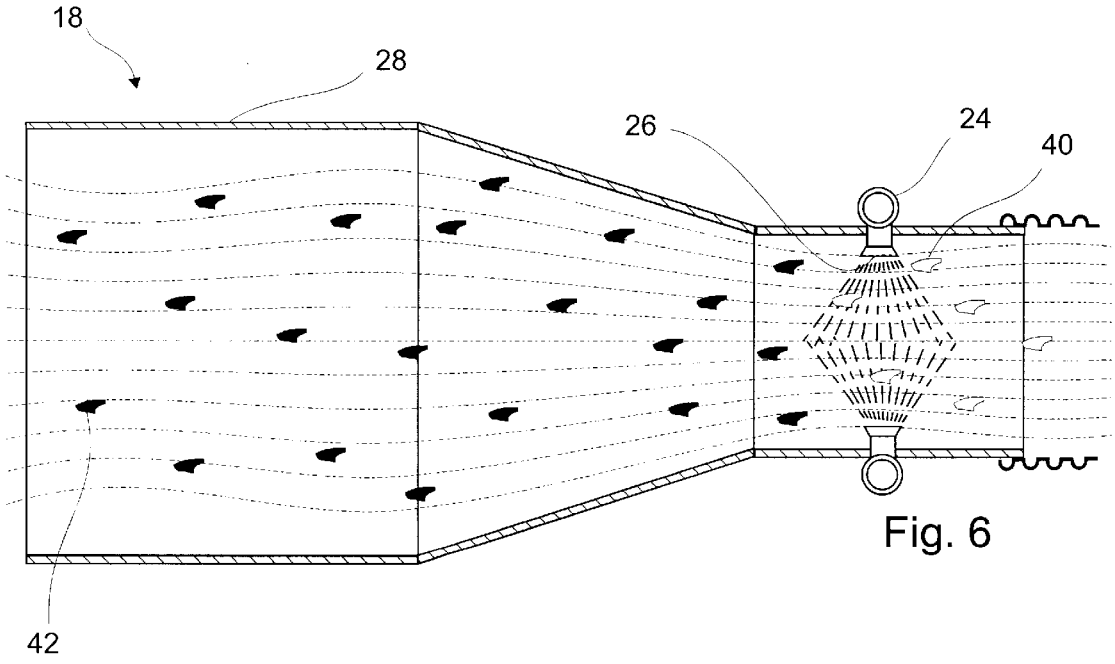
FIG. 6 is a cross-sectional view of still another embodiment of the present invention.

While the present invention depicts the fire extinguishing apparatus adapter 18 positioned adjacent the fire extinguishing apparatus 10, it is contemplated that the fire extinguishing apparatus adapter 18 could be modified to be disposed at any point along the hose such that its ends are sized to connect the hose 38. Optionally, the fire extinguishing adapter 18 can be integrated into the fire extinguishing apparatus 10, as part of the inlet 16, for example. FIGS. 5 and 6 depict alternative embodiments wherein the conduit 24 and open surfaces 28 are positioned in the intermediate section 36 and end 34, respectively.

The above described embodiment is set forth by way of example and is not for the purpose of limiting the present invention. It will be readily apparent to those skilled in the art that obvious modifications, derivations, and variations can be made to the embodiment without departing from the scope of the invention. Accordingly, the claims appended hereto should be read in their fill scope including any such modifications, derivations, and variations.

What is claimed is:

1. A fire extinguishing apparatus, which includes:

a conventional leaf collection apparatus of a type having a vacuum with an inlet and an associated hopper and converted for collecting and extinguishing Class A material; and a fire extinguishing adapter which includes:

a first conduit portion operably communicably connectable to the inlet of the vacuum;

an intermediate conduit portion communicably connected to said first conduit portion;

a second conduit portion communicably connected to said intermediate conduit portion and having means for collecting the Class A material; and means operably connected to one of said conduit portions for extinguishing the Class A material as the Class A material passes therethrough, wherein said extinguishing means includes a plurality of spray nozzles extending through said one conduit portion and are circumferentially spaced from each other in a manner such that extinguishing spray emanating from said spray nozzles cross to extinguish the Class A material in a radially inwardly manner.

2. The fire extinguishing apparatus of claim 1, wherein said collecting means includes a flexible conduit portion.

3. A fire extinguishing adapter apparatus for use with a conventional leaf collection apparatus of a type having a vacuum with an inlet and an associated hopper and to convert the leaf collection apparatus to a fire extinguishing apparatus useful for collecting and extinguishing Class A material, in which said fire extinguishing adapter apparatus includes:

a first conduit portion operably communicably connectable to the inlet of the vacuum;

an intermediate conduit portion communicably connected to said first conduit portion;

a second conduit portion communicably connected to said intermediate conduit portion and having means for collecting the Class A material; and means operably connected to one of said conduit portions for extinguishing the Class A material as the Class A material passes therethrough;

wherein said first conduit portion is of a larger diameter than said second conduit portion and said intermediate portion is of a tapered diameter interconnecting said first conduit portion and said second conduit portion.

4. The fire extinguishing adapter apparatus of claim 3, wherein said extinguishing means is disposed on said first conduit portion.

5. The fire extinguishing adapter apparatus of claim 3, wherein said extinguishing means is disposed on said intermediate conduit portion.

6. The fire extinguishing adapter apparatus of claim 3, wherein said extinguishing means is disposed on said second conduit portion.

* * * * *